US009149920B2

(12) United States Patent
Hoshino et al.

(10) Patent No.: US 9,149,920 B2
(45) Date of Patent: Oct. 6, 2015

(54) DRIVING TOOL INCLUDING A CONTACT ARM

(71) Applicant: MAX CO., LTD., Tokyo (JP)

(72) Inventors: Takamichi Hoshino, Tokyo (JP); Satoshi Shimoyama, Tokyo (JP); Mitugu Takezaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 320 days.

(21) Appl. No.: 13/652,710

(22) Filed: Oct. 16, 2012

(65) Prior Publication Data

US 2013/0105541 A1 May 2, 2013

(30) Foreign Application Priority Data

Oct. 26, 2011 (JP) ..... 2011-234855

(51) Int. Cl.

| | |
|---|---|
| ***B27F 7/00*** | (2006.01) |
| ***B25C 1/00*** | (2006.01) |
| ***B25C 7/00*** | (2006.01) |
| ***B25F 5/02*** | (2006.01) |

(52) U.S. Cl.
CPC ..... *B25C 1/008* (2013.01)

(58) Field of Classification Search
CPC ..... B27F 7/00; B25C 5/16; B25C 1/00; B25C 7/00; B25F 5/02
USPC ..... 227/8, 110, 9, 10, 11, 123
See application file for complete search history.

(56) References Cited

U.S. PATENT DOCUMENTS

| | | | | |
|---|---|---|---|---|
| 3,762,620 | A | 10/1973 | Geist | |
| 5,385,286 | A | 1/1995 | Johnson, Jr. | |
| 5,685,473 | A | 11/1997 | Shkolnikov et al. | |
| 5,732,870 | A | 3/1998 | Moorman et al. | |
| 7,490,747 | B2 | 2/2009 | Kitagawa | |
| 7,565,992 | B2 * | 7/2009 | Buetow | 227/110 |
| 8,752,744 | B2 * | 6/2014 | Okouchi et al. | 224/268 |
| 2003/0209584 | A1 * | 11/2003 | Shkolnikov et al. | 227/10 |
| 2005/0194421 | A1 * | 9/2005 | Smolinski et al. | 227/140 |
| 2006/0191973 | A1 * | 8/2006 | Chen et al. | 227/123 |
| 2008/0011806 | A1 | 1/2008 | Kitagawa | |
| 2010/0308098 | A1 | 12/2010 | Francis et al. | |
| 2011/0062207 | A1 | 3/2011 | Hlinka et al. | |
| 2011/0132959 | A1 * | 6/2011 | Hlinka et al. | 227/8 |
| 2013/0105541 | A1 * | 5/2013 | Hoshino et al. | 227/8 |

FOREIGN PATENT DOCUMENTS

| | | |
|---|---|---|
| JP | UM-A-S57-166676 | 10/1982 |
| JP | A-S63-28573 | 2/1988 |

(Continued)

OTHER PUBLICATIONS

Extended European Search Report dated Mar. 10, 2015 in corresponding European Patent Application No. 12007044.6.

*Primary Examiner* — Andrew M Tecco
*Assistant Examiner* — Praachi M Pathak
(74) *Attorney, Agent, or Firm* — Drinker Biddle & Reath LLP

(57) ABSTRACT

A driving tool is provided with a nose portion 16 from which a fastener is driven out, and a contact arm 20 which is slidable along the nose portion. The contact arm 20 includes a U-type leading end portion 20*a*. A leading end of the nose portion 16 enters an inside of a U-type part of the leading end portion 20*a* of the contact arm 20 when the contact arm 20 slides toward a base end of the nose portion 16. The leading end portion of the nose portion 16 includes a receiving portion 22, 23 by which a load applied to the contact arm is received.

4 Claims, 16 Drawing Sheets

(56) References Cited

FOREIGN PATENT DOCUMENTS

| | | | |
|---|---|---|---|
| JP | 10286783 | A | 10/1998 |
| JP | A-H10-286784 | | 10/1998 |
| JP | A-2000-176856 | | 6/2000 |
| JP | A-2009-83060 | | 4/2009 |
| JP | 2010023174 | A | 2/2010 |
| JP | A-2010-76060 | | 4/2010 |

* cited by examiner

DRIVING TOOL INCLUDING A CONTACT ARM

BACKGROUND OF THE INVENTION

1. Field of the Invention

The present invention relates to a driving tool.

2. Related Art

A driving tool including a contact arm has been known.

The contact arm is slidable with respect to a nose portion of the driving tool. A leading end portion of the contact arm is urged by a spring or the like so as to protrude in a driving direction of a fastener so that a leading end portion of the contact arm is easily pressed against a work-piece. The leading end portion protrudes forward more than a leading end of the nose portion. Moreover, the other end portion of the contact arm is indirectly or directly engaged with a trigger mechanism for operating the driving tool.

When the leading end portion of the contact arm is pressed against the work-piece, the contact arm is pushed in a direction opposite to the driving direction of the fastener, and the other end portion of the contact arm acts on the trigger mechanism, so that an operation of the trigger becomes effective. That is, by actions that the leading end portion of the contact arm is pressed against the work-piece and the trigger is operated, a driving of the fastener is performed. In other words, even though the trigger is operated in a state in which the leading end portion of the contact arm is not pressed against the work-piece, the driving of the fastener is not performed.

There is known various types of the contact arm. For example, in Patent Document 1 and Patent Document 2, there is disclosed a wire-rod type contact arm which is made of a wire rod. In the case of using the wire-rod type contact arm, a lightweight and inexpensive contact arm is advantageously manufactured.

Patent Document 1: JP-A-10-286783

Patent Document 2: US2006/0191973

Since the contact arm protrudes forward further than the leading end face of the nose portion, the contact arm is likely to be deformed if it collides on a concrete surface or the like at the time of falling. In particular, the wire-rod type contact arm is likely to be deformed.

Although the deformation of the contact arm would be suppressed by increasing a wire diameter or complicating a wire shape, then an increased cost or an increased weight would occur.

SUMMARY OF THE INVENTION

One or more embodiments of the invention provide a driving tool which can effectively suppress a deformation of a wire-rod type contact arm.

According to the embodiments, a driving tool may include a nose portion 16 that guides a fastener, and a contact arm 20 which is slidable along the nose portion 16. The contact arm 20 may include a U-type leading end portion 20*a* in which a wire rod is bent in a surface intersecting to a driving direction of the fastener. The nose portion 16 and the contact arm 20 may be arranged such that a leading end of the nose portion 16 is placed inside of a U-type part of the leading end portion 20*a* of the contact arm 20 by a sliding of the contact arm 20 toward a base end of the nose portion. The leading end portion of the nose portion 16 may be provided with a receiving portion 22, 23 by which a load applied to the contact arm is received.

DETAILED DESCRIPTION OF THE EMBODIMENTS

An embodiment will now be described with reference to the accompanying drawings.

Figure 1:
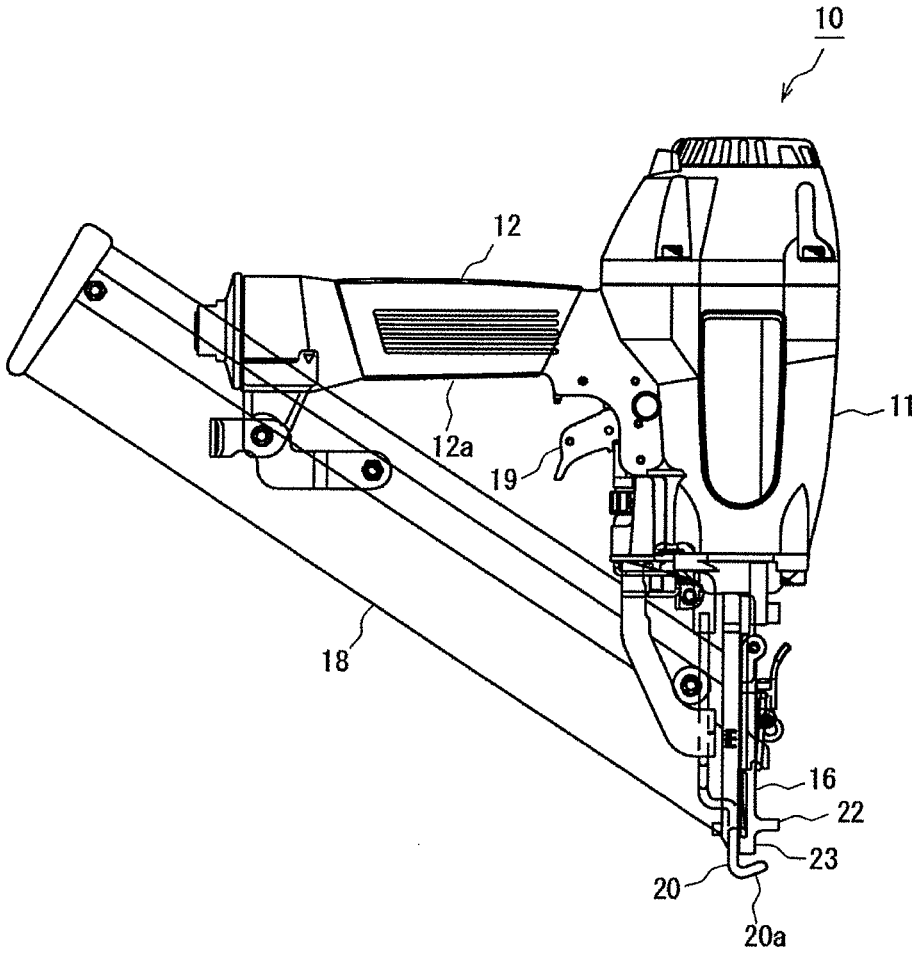
FIG. 1 is a side view of a driving tool according to an embodiment.
Figure 2:
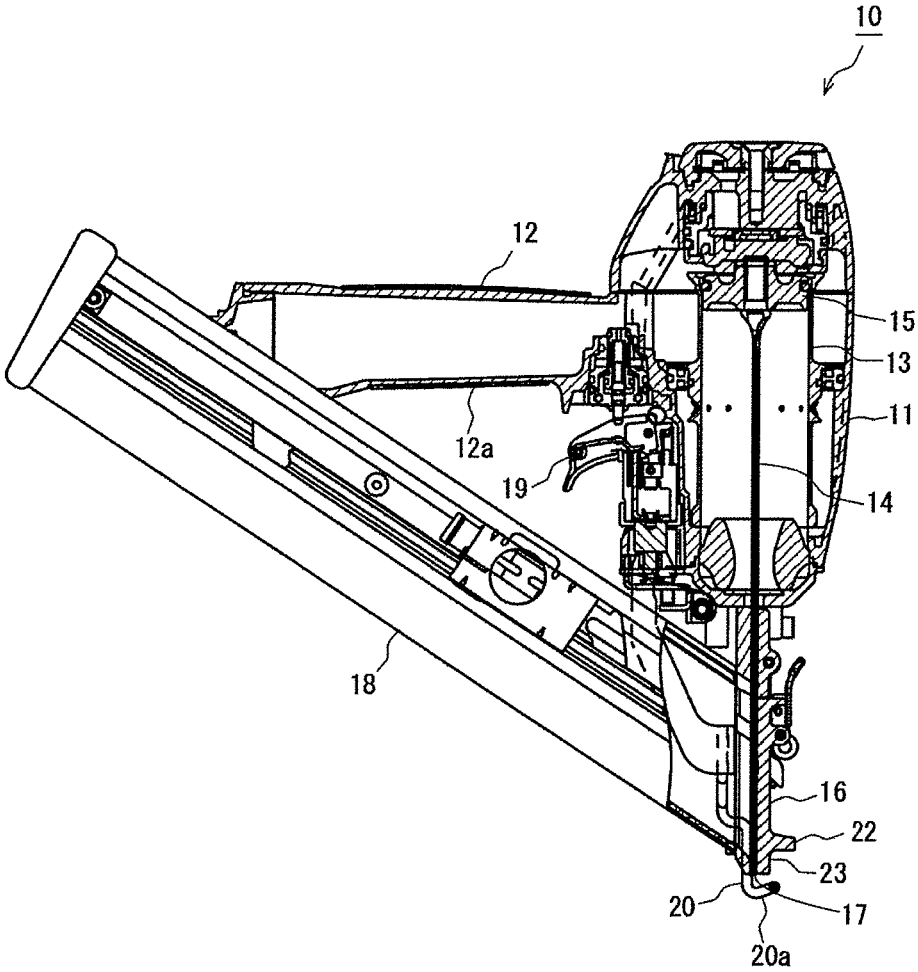
FIG. 2 is a cross-sectional view of the driving tool according to the embodiment.
Figure 3:
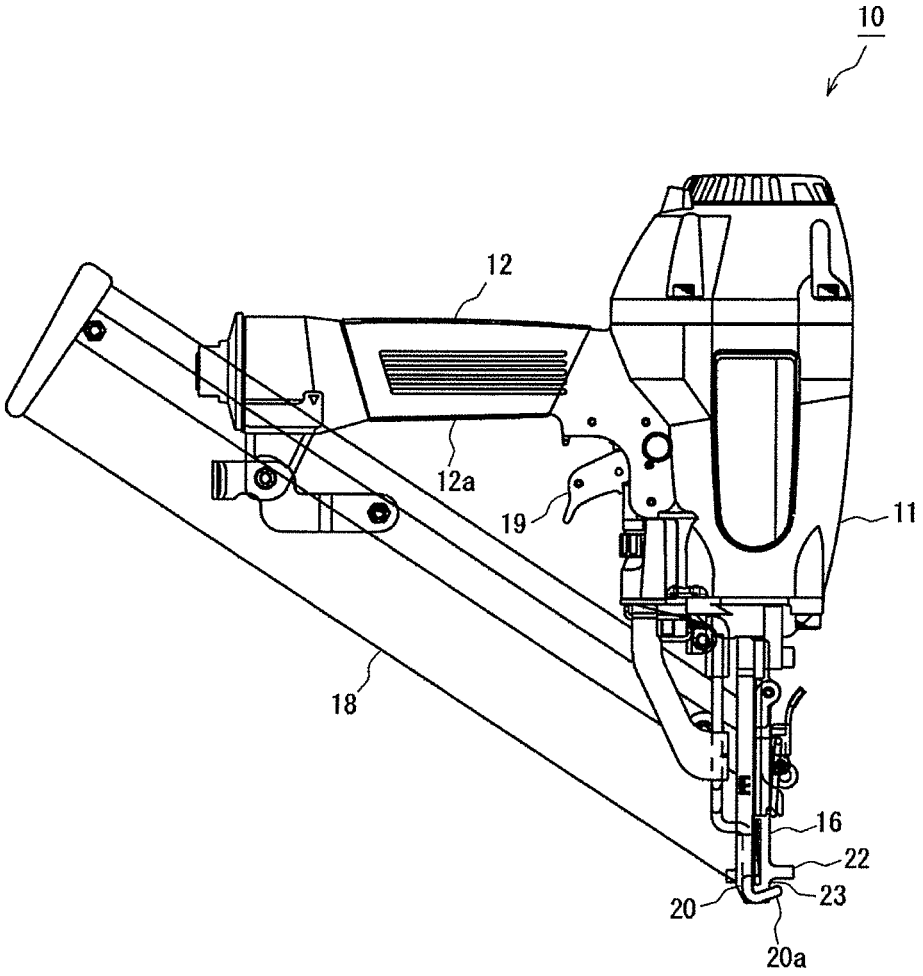
FIG. 3 is a side view of the driving tool according to the embodiment, in a state in which a contact arm is pressed against a work-piece or the like, and then is slid.

As illustrated in FIGS. 1 to 3, a driving tool 10 according to this embodiment includes a body housing 11 accommodating a driving cylinder 13 therein, a grip housing 12 connected to a rear portion of the body housing 11, and a driving piston 15 slidably accommodated in the driving cylinder 13 and coupled to a bottom side of a driver 14 for driving a nail. A nose portion 16 is attached to a lower portion of the body housing 11, and is provided with an ejection port 17 for driving and guiding a fastener toward a work-piece. The driver 14 coupled to the driving piston 15 is slidably accommodated and guided in the nose portion 16.

A magazine 18 loaded with a plurality of fasteners is connected to a rear side of the nose portion 16, and the fasteners in the magazine 18 are sequentially fed to the nose portion 16. The nail fed to the nose portion 16 is driven by the driver 14, and is driven out from the ejection port 17 to the work-piece.

A trigger 19 is disposed on a base portion of a grip portion 12*a*, and a plug for connecting a compressed-air supply hose is installed at a rear end of the grip portion 12*a*. Compressed air fed from the plug passes through the inside of the grip portion 12*a* by operation of the trigger 19, and then is supplied to the driving cylinder 13. In this way, the driving cylinder 15 is slid to operate the driver 14, thereby driving the fastener.

A contact arm 20 which is slid along the nose portion 16 is installed in the vicinity of the nose portion 16. The contact arm 20 is pressed by a spring, so that a leading end portion 20*a* thereof protrudes forward further than a leading end face of the nose portion 16. Also, the other end portion of the contact arm 20 is indirectly or directly engaged with a trigger mechanism which is operated by manipulation of the trigger 19.

If the leading end portion 20*a* of the contact arm 20 is pressed against the work-piece, the contact arm 20 is pushed in a direction opposite to a driving direction of the fastener, and the other end portion of the contact arm 20 acts on the trigger mechanism, so that operation of the trigger 19 becomes effective. That is, in the state in which the leading end portion 20*a* of the contact arm 20 is pressed against the work-piece, the trigger 19 is operated, so that driving of the fastener is performed. In other words, even though the trigger 19 is operated in the state in which the leading end portion 20*a* of the contact arm 20 is not pressed against the work-piece, the driving of the fastener is not performed. Also, in the sequence of the operation, the trigger 19 may be operated after the leading end portion 20*a* of the contact arm 20 is pressed against the work-piece, or the leading end portion 20*a* of the contact arm 20 may be pressed against the work-piece in the state in which the trigger 19 is operated. The driving of the fastener is performed only when two signs of the contact arm 20 and the trigger 19 enter.

Although the structure of the trigger mechanism is not specifically illustrated herein, a known mechanism disclosed in, for example, JP-A-2010-023174 can be employed.

Figure 4:
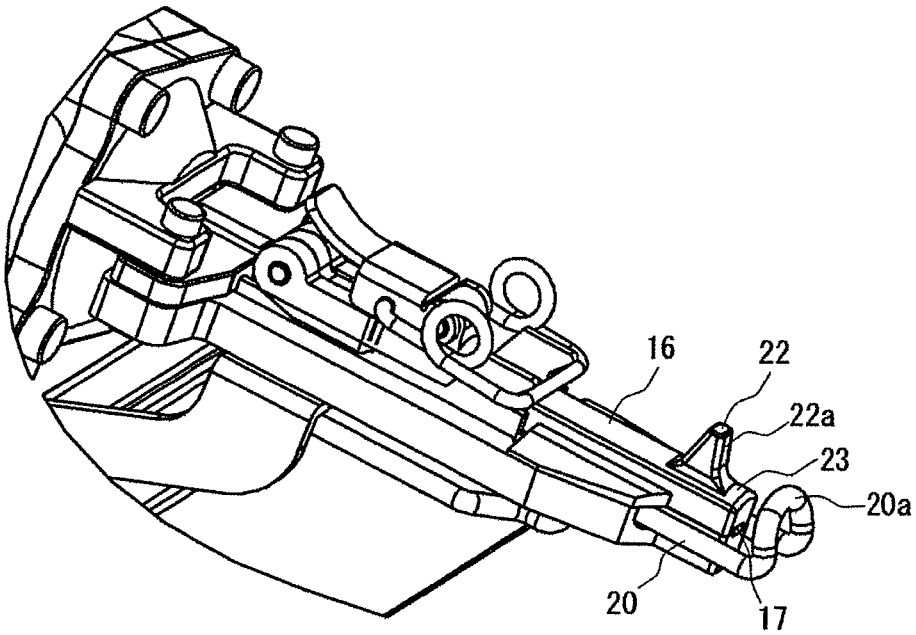
FIG. 4 is a partially enlarged perspective view of a nose portion according to the embodiment, in a state in which the contact arm protrudes.
Figure 5:
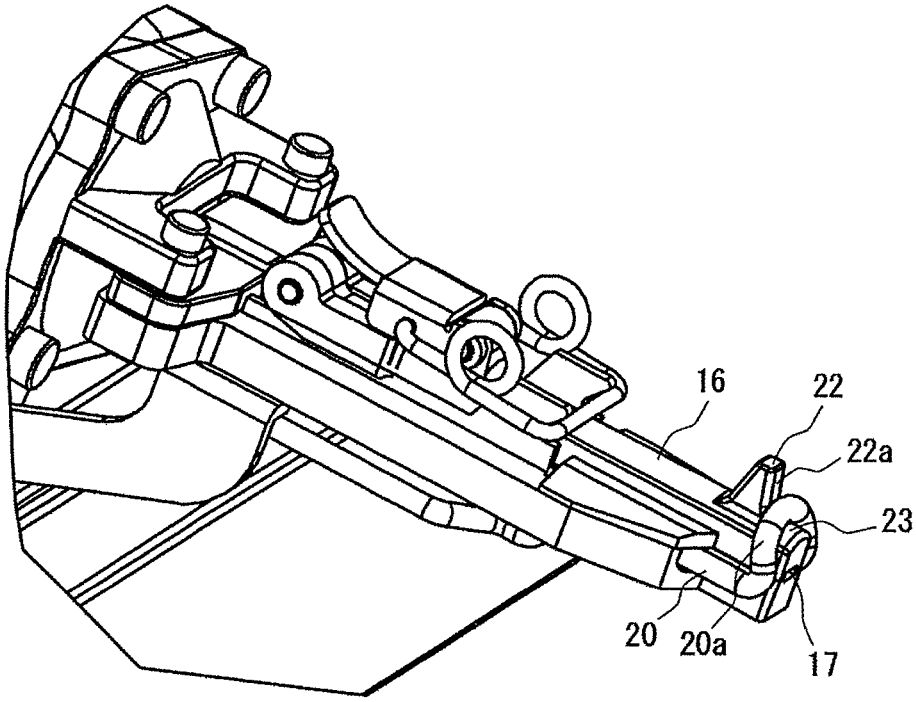
FIG. 5 is a partially enlarged perspective view of the nose portion according to the embodiment, in a state in which the contact arm is pushed.
Figure 6:
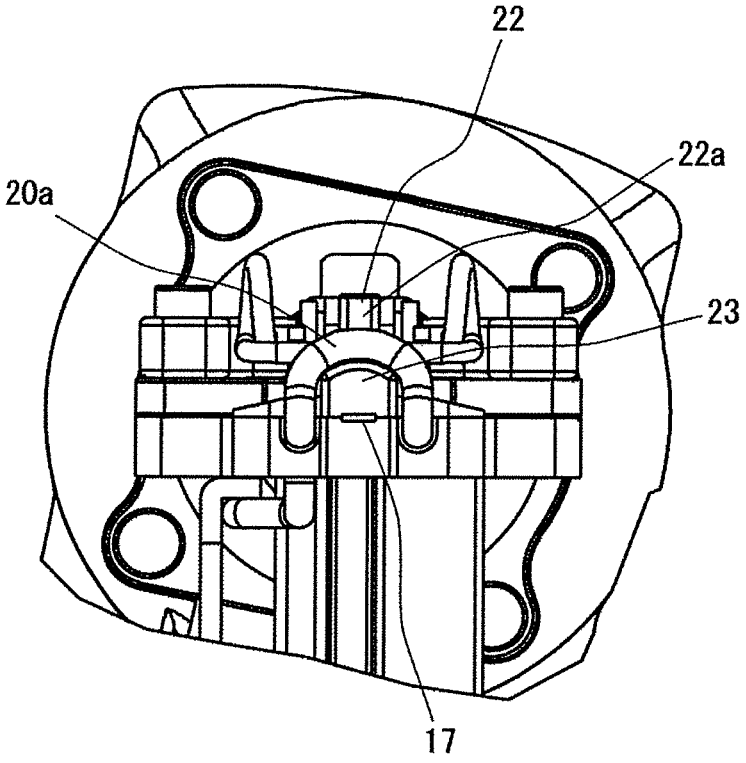
FIG. 6 is a partially enlarged perspective view of the nose portion according to the embodiment, when seen from a direction orienting an ejection port.

The contact arm 20 according to this embodiment is a wire-rod type contact arm 20 made of a wire rod, as illustrated in FIGS. 4 to 6. In the contact arm 20, the wire-rod is folded back at its leading end portion 20*a*, and the leading end portion 20*a* is bent at a substantially right angle in a direction opposite to the grip portion 12*a*.

If the contact arm 20 is pressed against the work-piece, as illustrated in FIGS. 3 and 5, the contact arm 20 is pushed in a direction opposite to the driving direction of the fastener, and thus is slid, so that the leading end portion of the nose portion 16 comes in the inside of the U-typed leading end portion 20*a* of the contact arm 20.

The leading end portion of the nose portion 16, in which the U-typed leading end portion 20*a* of the contact arm 20 comes, is provided with a receiving portion by which a load applied to the contact arm 20 is received. A build-up portion 23 and a projection 22 are provided as the load receiving portion.

The build-up portion 23 is provided to be opposed to the inside of the U-typed leading end portion 20*a* of the contact arm 20 when the contact arm 20 is pushed and slid. To reduce a gap between the inner peripheral side of the U-typed leading end portion 20*a* and the build-up portion 23, the build-up portion 23 is formed to have a U-type cross section perpendicular to the driving direction so as to correspond to a shape of an inner side of a U-typed part of the U-typed leading end portion 20*a*. As the build-up portion 23 is provided, the gap between the inner peripheral side of the U-typed leading end portion 20*a* and the build-up portion 23 is set to be small. In this embodiment, the clearance between the U-typed leading end portion 20*a* of the contact arm 20 and the build-up portion 23 is set as 1.4 mm or less.

The projection 22 abuts against the U-typed leading end portion 20*a* of the contact arm 20, as illustrated in FIGS. 4 to 6, when the contact arm 20 is pushed and slid. The projection 22 is provided to protrude more than the contact arm 20 in a direction opposite to the grip portion 12*a*. In this embodiment, a height of the projection is set as about 12 mm. Also, the height of the projection 22 is set to be higher than a slope of 35 degrees from the leading end portion of the nose portion 16 (see FIG. 8(*a*)).

The driving tool 10 according to this embodiment includes the build-up portion 23 and the projection 22. As a result, even in the case where the driving tool 10 is fallen and thus the load is applied to the contact arm 20, it is possible to prevent deformation of the contact arm 20.

Now, the operation of the deformation prevention mechanism according to this embodiment will be described. First, the operation in the case in which a driving tool 10 of the related art having no deformation prevention mechanism according to this embodiment will be described.

Figure 18A:
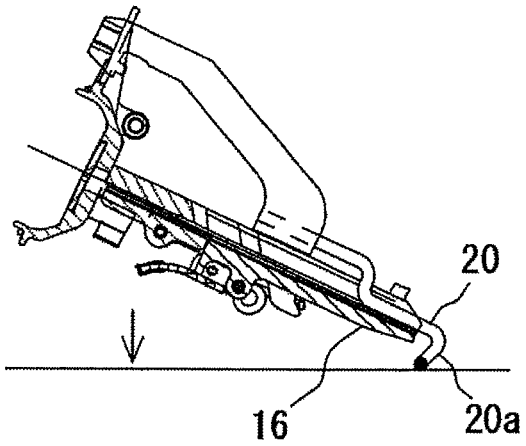
FIGS. 18(*a*) to 18(*c*) are diagrams illustrating operation of a contact arm of a driving tool of the related art in a case in which the contact arm is fallen at a sharp angle.
Figure 18B:
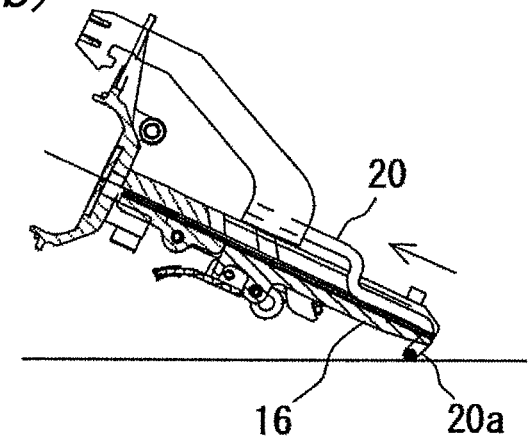
Figure 18C:
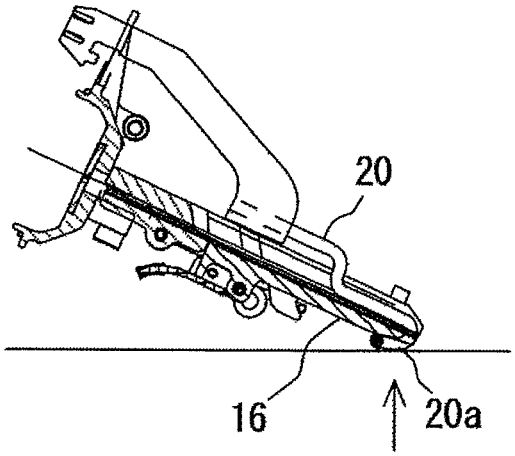

As illustrated in FIGS. 18(*a*) to 18(*c*), for the driving tool 10 of the related art having no build-up portion 23 or projection 22, in the case where the contact arm 20 is fallen at a sharp angle (falling case where a driving direction is an angle of 35 degrees or more to a ground), as the contact arm 20 collides on a concrete surface or the like, a component acts in a direction to slide the contact arm 20, so that the contact arm 20 is pushed and slid (see FIG. 18(*b*)). After that, the load is applied to the contact arm 20 from the time when the sliding movement is finished, the leading end portion 20*a* of the contact arm 20 or the like is deformed (see FIG. 18(*c*)).

Figure 19A:
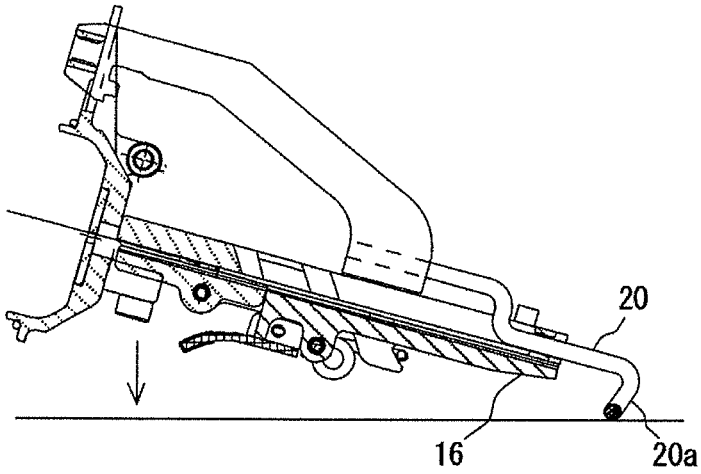
FIGS. 19(*a*) and 19(*b*) are diagrams illustrating operation of the contact arm of the driving tool of the related art in a case in which the contact arm is fallen at a gentle angle.
Figure 19B:
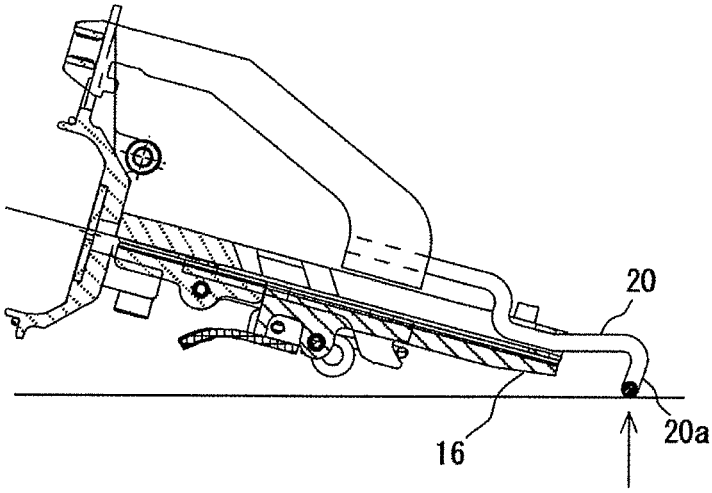

As illustrated in FIGS. 19(*a*) and 19(*b*), for the driving tool 10 of the related art, in the case where the contact arm 20 is fallen at a gentle angle (falling case where the driving direction is an angle of less than 35 degrees to a ground), as the contact arm 20 collides on the concrete surface or the like, a component acting in a direction to slide the contact arm 20 is small, so that the contact arm 20 is not moved. The load is applied to the contact arm 20 in a direction to bend the contact arm 20 toward the grip portion 12*a*, so that the contact arm 20 is deformed.

Meanwhile, the deformation prevention mechanism according to this embodiment can effectively suppress the deformation of the contact arm 20, as described above.

Figure 7A:
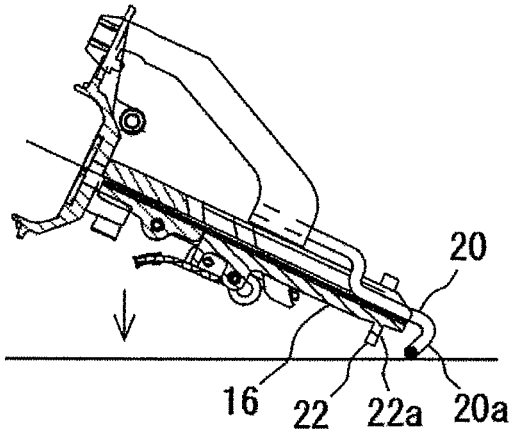
FIGS. 7(*a*) to 7(*c*) are diagrams illustrating operation of a deformation prevention mechanism according to the embodiment to explain operation of a projection in a case in which the contact arm is fallen at a sharp angle.
Figure 7B:
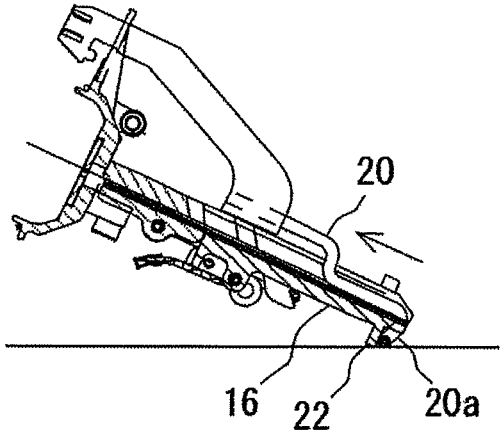
Figure 7C:
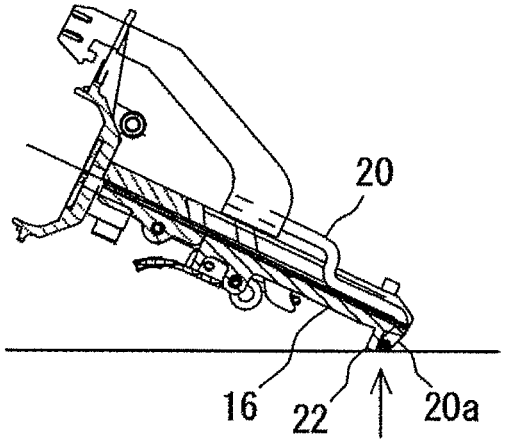

That is, in the case of including the projection 22 according to this embodiment, as illustrated in FIGS. 7(*a*) to 7(*c*), if the contact arm 20 is fallen at a sharp angle and then collides on the concrete surface or the like (see FIG. 7(*a*)), the contact arm 20 is pushed and slid by the collision with the concrete surface or the like (see FIG. 7(*b*)). At that time, since the leading end portion 20*a* of the contact arm 20 comes into contact with a contact surface 22*a* of the projection 22 at the leading end side thereof, the projection 22 receives the load to bend the contact arm 20 in an upward direction, thereby preventing the contact arm 20 from being deformed (see FIG. 7(*c*)).

Figure 8A:
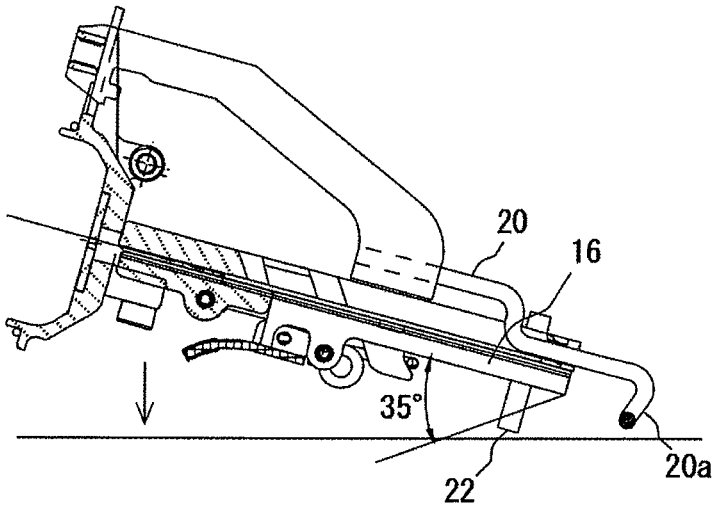
FIGS. 8(*a*) and 8(*b*) are diagrams illustrating operation of a deformation prevention mechanism according to the embodiment to explain operation of the projection in a case in which the contact arm is fallen at a gentle angle.
Figure 8B:
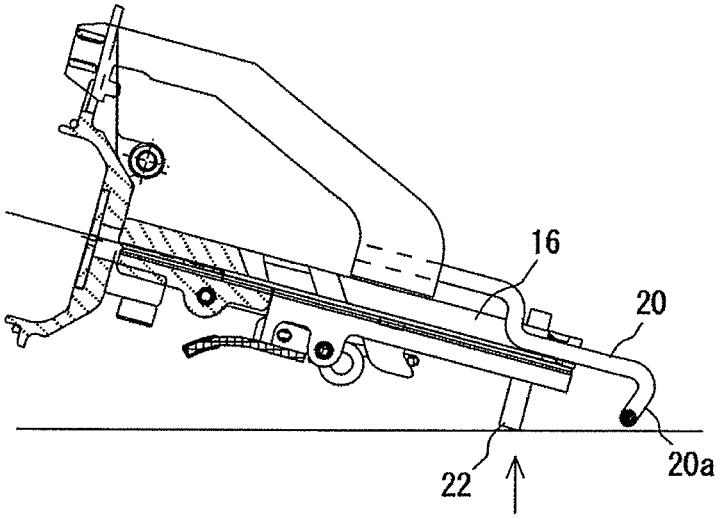

Also, as illustrated in FIGS. 8(*a*) and 8(*b*), in the case where the contact arm 20 is fallen at a gentle angle, since the projection 22 comes into contact with the ground earlier than or almost simultaneously with the contact arm 20, it is possible to reduce the load which is directly applied to the contact arm 20, thereby preventing the contact arm 20 from being deformed.

Figure 9A:
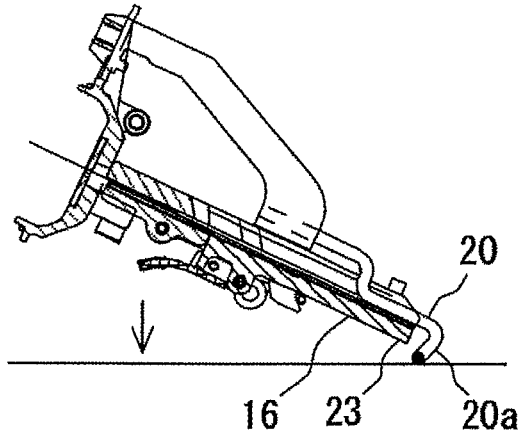
FIGS. 9(*a*) to 9(*c*) are diagrams illustrating operation of a deformation prevention mechanism according to the embodiment to explain operation of a build-up portion.
Figure 9B:
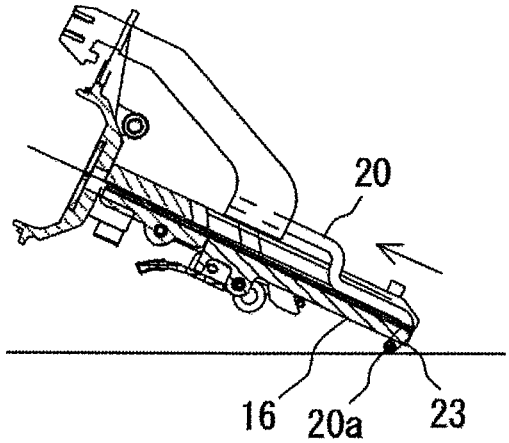
Figure 9C:
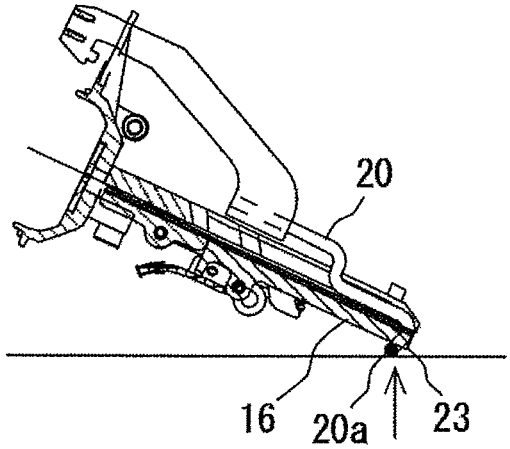

Moreover, in the case of including the build-up portion 23 according to this embodiment, as illustrated in FIGS. 9(*a*) to 9(*c*), in the case where the contact arm 20 is fallen at a sharp angle and then collides on the concrete surface or the like (see FIG. 9(*a*)), the contact arm 20 is pushed and slid by the collision with the concrete surface or the like. When the leading end portion of the nose portion 16 comes in the contact arm 20 (see FIG. 9(*b*)), the build-up portion 23 is formed on the leading end portion of the nose portion 16 in the range of sliding the contact arm 20. As the build-up portion 23 is formed, the build-up portion 23 can receive the load to bend the contact arm 20 in the upward direction, thereby preventing the contact arm 20 from being deformed (see FIG. 9C).

In the above description with reference to FIGS. 7 to 9, for the sake of convenience, the build-up portion 23 and the projection 22 have been respectively described for the case including a separate member. However, even in the case where both the build-up portion 23 and the projection 22 are included, mutual functions are not decreased. It is possible to complexly suppress the deformation of the contact arm 20 by including both members.

As described above, according to this embodiment, since the leading end portion of the nose portion 16 is provided with the receiving portion for receiving the load applied to the contact arm 20, even though the contact arm 20 collides on the concrete surface or the like at the time of falling, the load generated by the impact can be absorbed by the receiving portion installed at the leading end portion of the nose portion 16, thereby preventing the deformation of the contact arm 20.

Also, since the build-up portion 23 is provided as the load receiving portion, which is opposed to the inside of the U-typed leading end portion 20*a* of the contact arm 20 when the contact arm 20 is pushed and slid, the load applied to the contact arm 20 can be absorbed by the build-up portion 23, thereby preventing the deformation of the contact arm 20.

Moreover, since the projection 22 is provided as the load receiving portion, which abuts against the U-typed leading end portion 20*a* of the contact arm 20 when the contact arm 20 is pushed and slid, the load applied to the contact arm 20 can be absorbed by the projection 22, thereby preventing the deformation of the contact arm 20.

Since the projection 22 is provided to protrude forward further than the contact arm 20 in a position opposite to the grip portion 12*a*, even in the case where the driving tool 10 is fallen from the side opposite to the grip portion 12*a*, the projection 22 first comes into contact with the concrete surface or the like earlier than the contact arm 20, thereby preventing the deformation of the contact arm 20.

The above embodiment of the present invention is not limited thereto.

Figure 10:
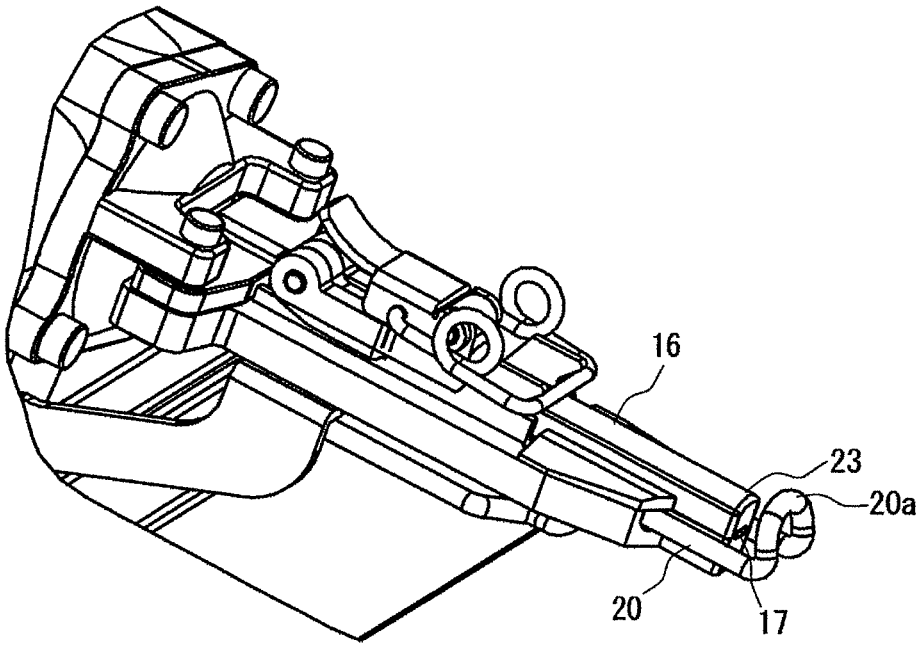
FIG. 10 is a partially enlarged perspective view of a nose portion according to a first modification, in a state in which the contact arm protrudes.
Figure 11:
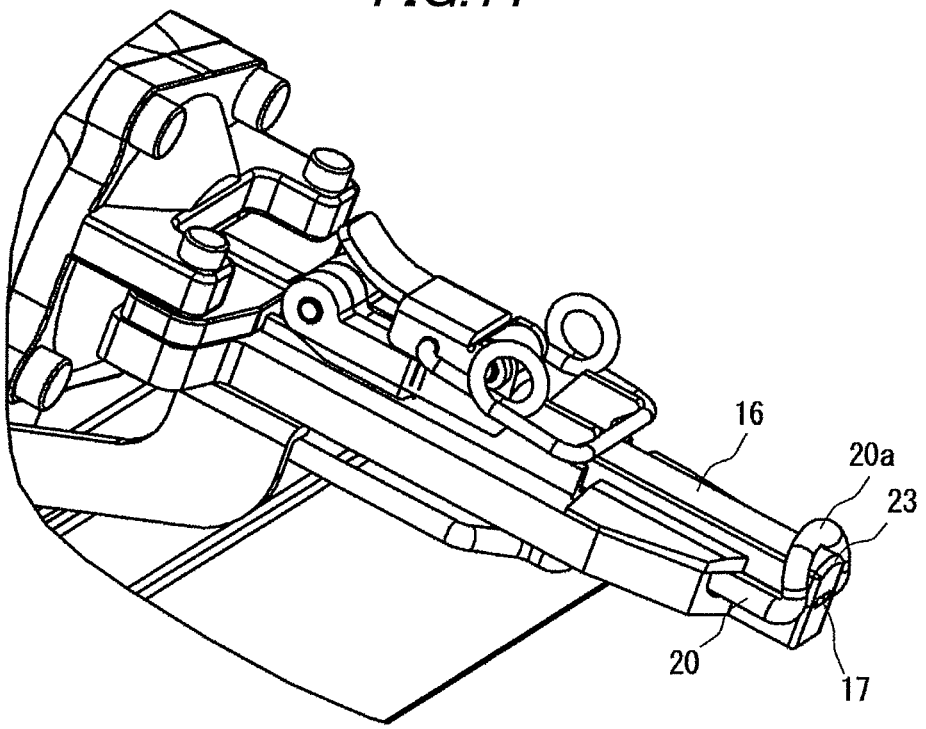
FIG. 11 is a partially enlarged perspective view of the nose portion according to the first modification, in a state in which the contact arm is pushed.
Figure 12:
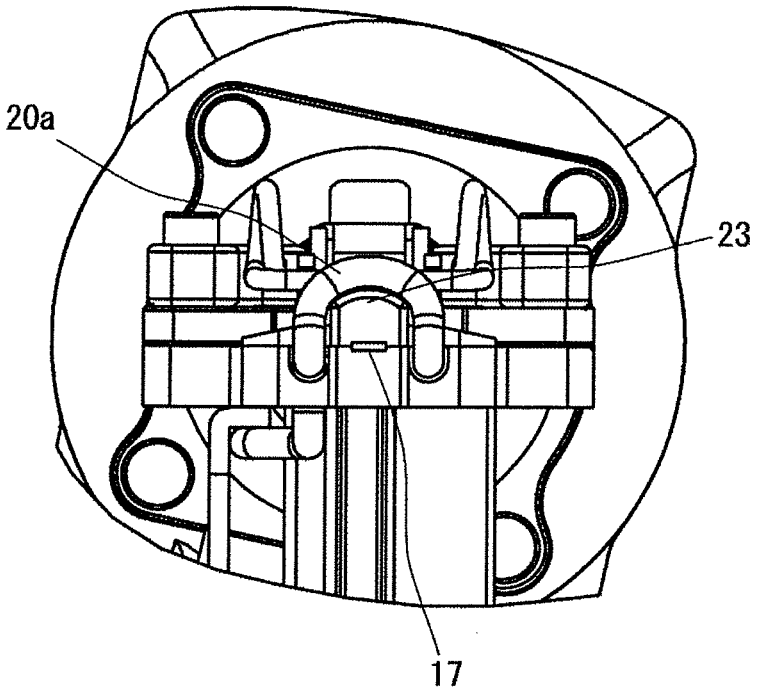
FIG. 12 is a partially enlarged perspective view of the nose portion according to the first modification, when seen from the direction orienting the ejection port.

For example, as illustrated in FIGS. 10 to 12, only the build-up portion 23 may be provided, without installing the projection 22. For example, in a case where the wire rod of the contact arm 20 is thick in thickness, the deformation of the contact arm 20 is suppressed, without installing the projection 22. In this instance, as the projection 22 is omitted, a manufacturing cost thereof can be reduced. Also, since the nose portion 16 is made compact by eliminating the projection 22, the nose portion 16 can come in a narrow space, and be easily aimed to a driving point.

Figure 13:
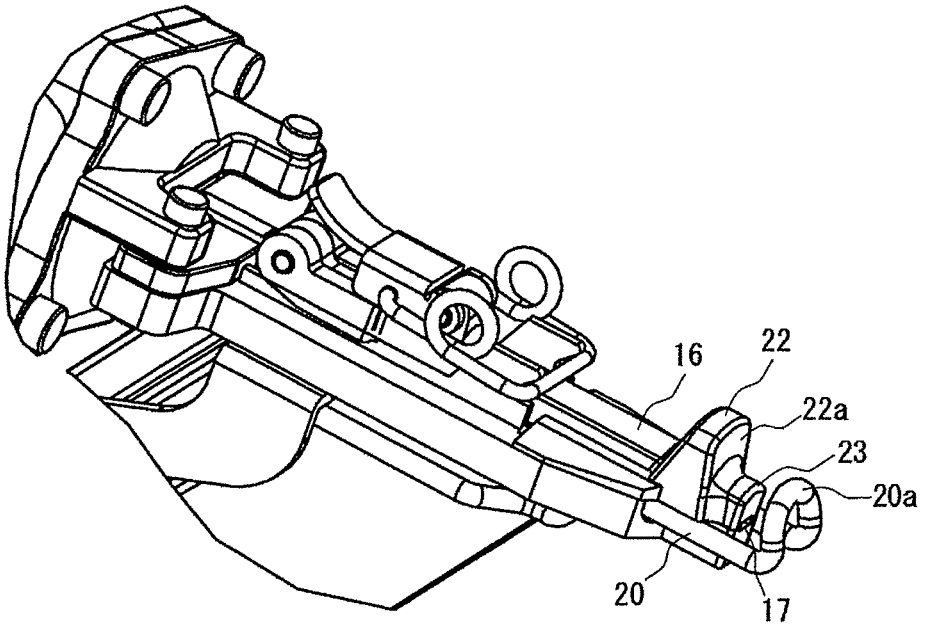
FIG. 13 is a partially enlarged perspective view of a nose portion according to a second modification.

As illustrated in FIG. 13, the projection 22 is formed to receive the whole leading end portion 20*a* of the contact arm 20, thereby increasing an area to receive the load of the contact arm 20.

Figure 14:
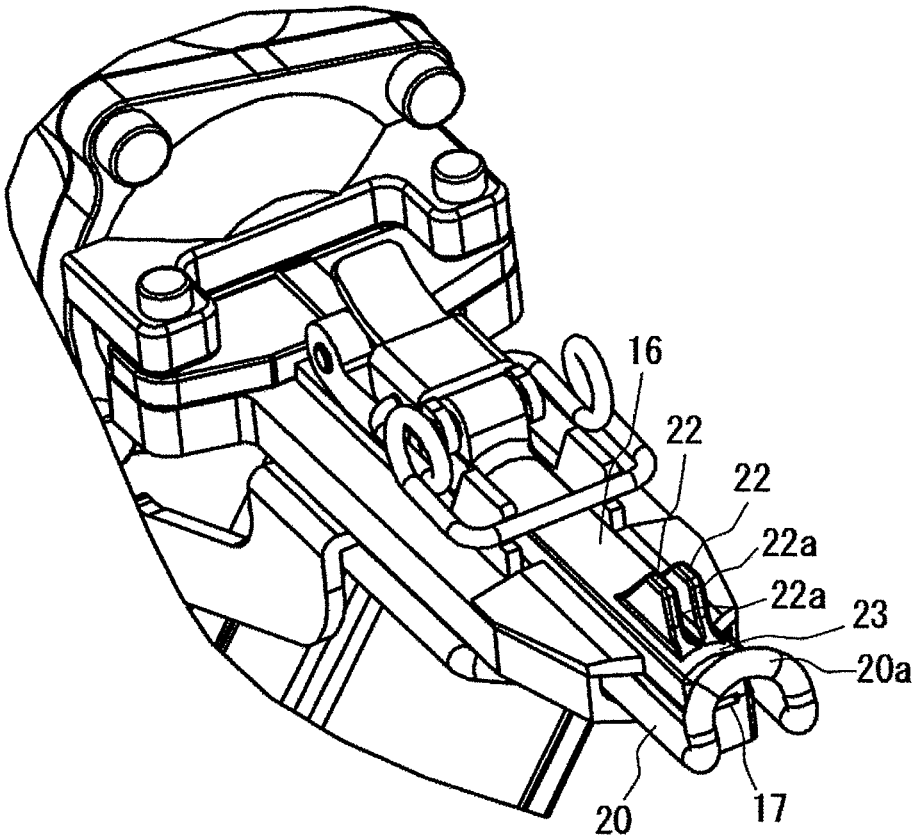
FIG. 14 is a partially enlarged perspective view of a nose portion according to a third modification.

As illustrated in FIG. 14, a plurality of projections 22 may be provided so that the load of the contact arm 20 is received at plural positions.

Figure 15:
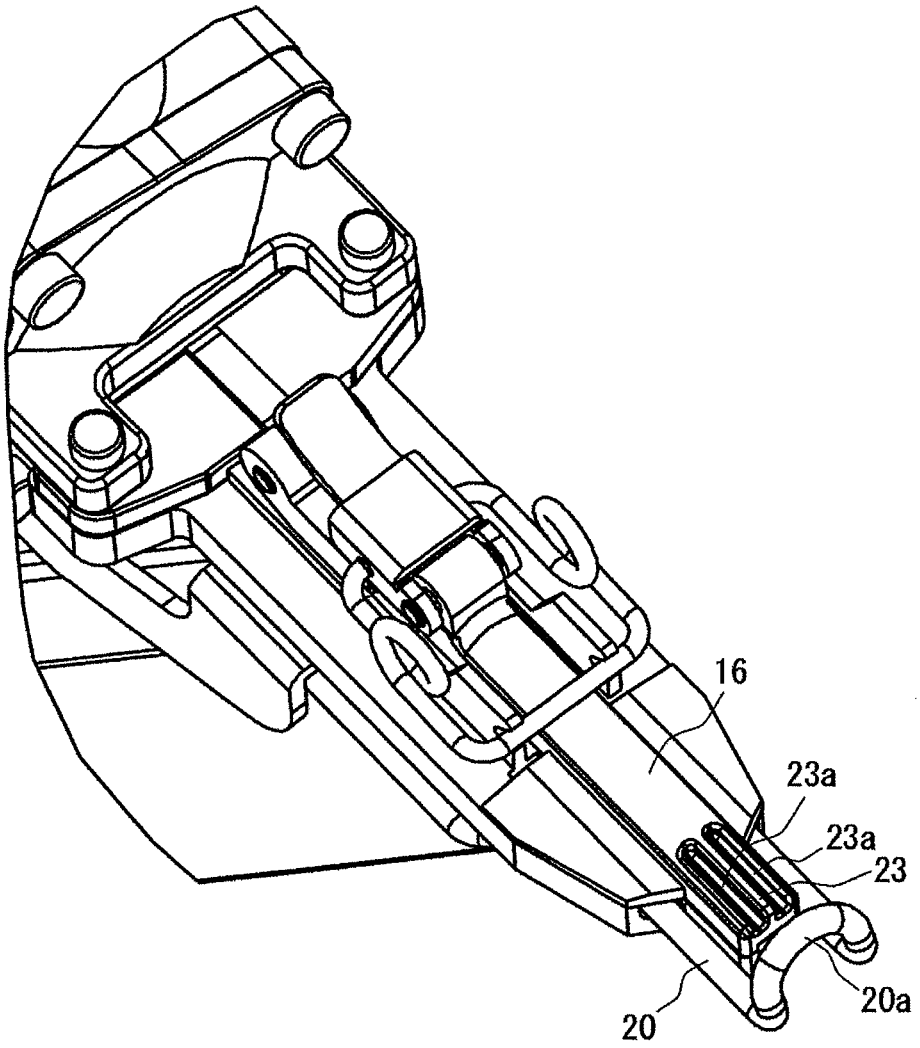
FIG. 15 is a partially enlarged perspective view of a nose portion according to a fourth modification.
Figure 16:
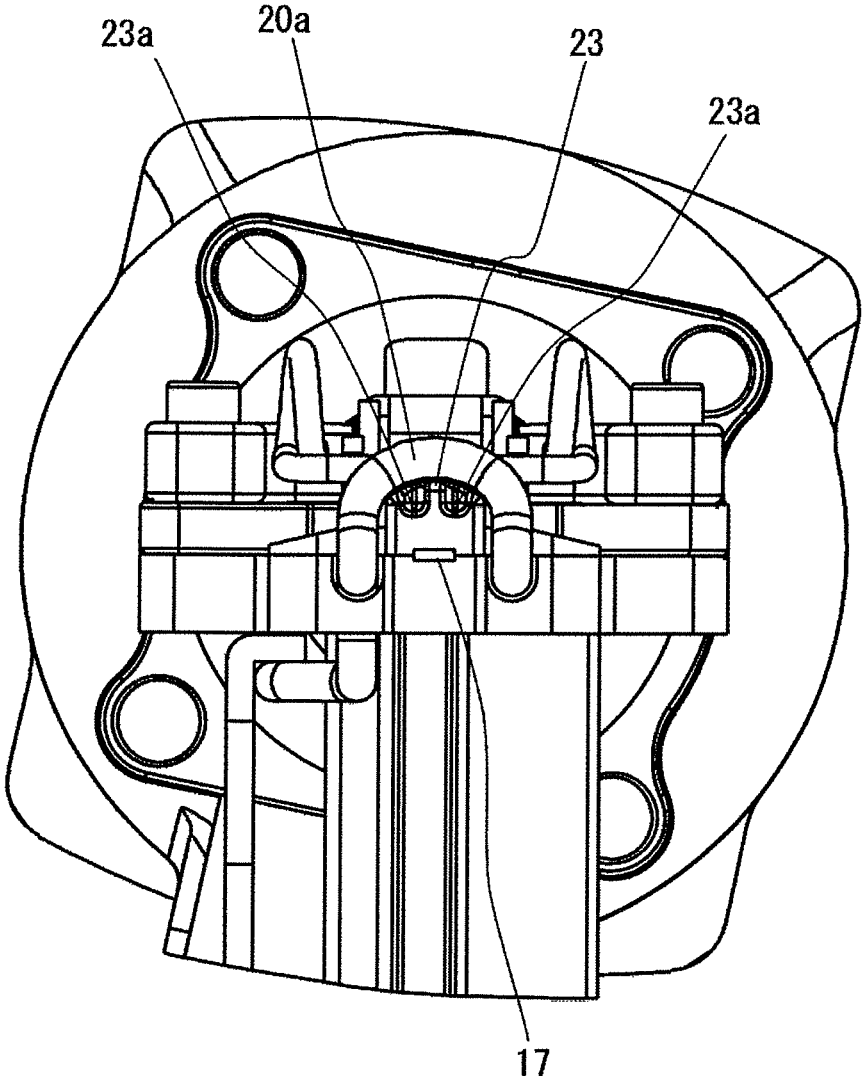
FIG. 16 is a partially enlarged perspective view of the nose portion according to the fourth modification, when seen from the direction orienting the ejection port.

As illustrated in FIGS. 15 and 16, the build-up portion 23 may be provided with a groove portion 23*a*. In other words, the build-up portion 23 is not limited to the aspect in which it is provided at the whole area of the leading end portion of the nose portion 16 which is opposed to the inside of the U-typed leading end portion 20*a* of the contact arm 20, but the build-up portion 23 may be formed at a portion of the leading end portion of the nose portion 16.

Further, in the present description, the term "U-type" means a shape defined by a line extending from one side to the other side and turned back from the other side to the one side at an end of the other side. Examples of the "U-type" may be "U-shape", "V-shape", and "C-shape". That is, the "U-type leading end" may be, for example, a "V-shape leading end".

Figure 17:
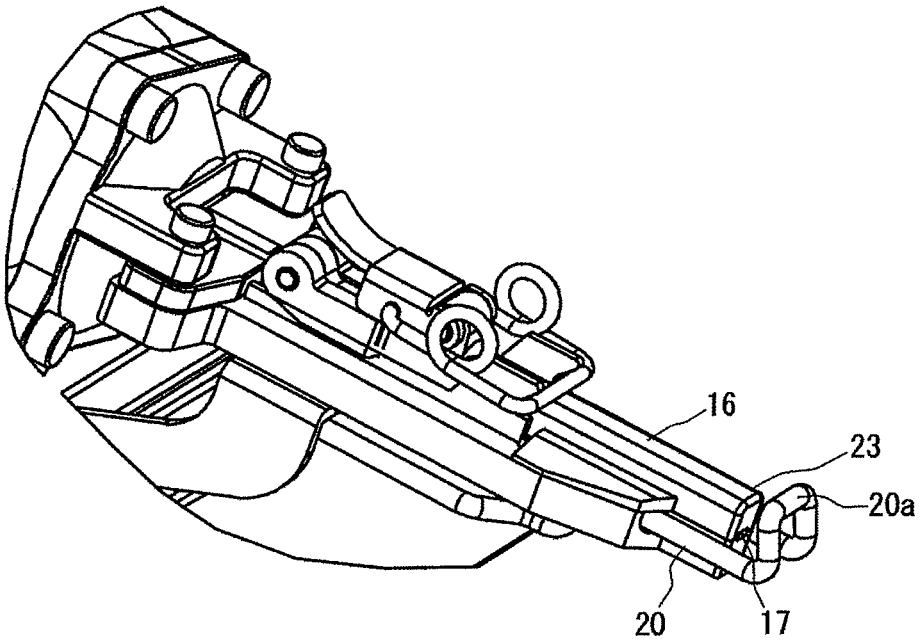
FIG. 17 is a partially enlarged perspective view of a nose portion according to a fifth modification.

If the leading end portion 20*a* of the contact arm 20 has an angular U-shape as shown in FIG. 17, the build-up portion 23 may have an angular U-shape cross section, to conform with the shape of the leading end portion 20*a* of the contact arm 20.

Moreover, in the above embodiment, the contact arm 20 is formed by connecting two leading end portions 20*a* of wire-type arms which are extended in both sides of the nose portion 16, but the present invention is not limited thereto. For example, two wire type arms extended to both sides of the nose portion 16 may be connected to each other in the nose portion 16. That is, the leading end portions 20*a* may be formed in a substantially U-type and be spaced apart from each other.

In this embodiment, the driving tool 10 operated by the compressed air is given as an example, but the embodiment of the present invention is not limited thereto. It does not matter as long as it is the driving tool 10 including the contact arm 20. For example, the present invention can be applied to an electric driving tool or a gas combustion type driving tool.

In accordance with an embodiment, a driving tool may include a nose portion 16 that guides a fastener, and a contact arm 20 which is slidable along the nose portion. The contact arm 20 may include a U-type leading end portion 20*a* in which a wire rod is bent into a U-type in a surface intersecting to a driving direction of the fastener. The nose portion 16 and the contact arm 20 may be arranged such that a leading end of the nose portion 16 is placed inside of a U-type part of the leading end portion 20*a* of the contact arm 20 by a sliding of the contact arm 20 toward a base end of the nose portion 16. The leading end portion of the nose portion 16 may be provided with a receiving portion 22, 23 by which a load applied to the contact arm is received.

According this structure, since the leading end portion of the nose portion is provided with the receiving portion for receiving the load applied to the contact arm, even though the contact arm collides on the concrete surface or the like at the time of falling, the load generated by the impact can be absorbed by the receiving portion provided at the leading end portion of the nose portion, thereby preventing the deformation of the contact arm.

In the above structure, the receiving portion may include a build-up portion 23 formed on the nose portion 16 and having a U-type cross section corresponding to a shape of an inner side of the U-type part of the leading end portion 20*a* of the contact arm 20.

According to this structure, the build-up portion is opposed to an inside of the U-type leading end portion of the contact arm when the contact arm is pushed. Therefore, the load applied to the contact arm is absorbed by the build-up portion, thereby preventing the contact arm from being deformed.

That is, when the contact arm collides on the concrete surface or the like at the time of falling, the contact arm is first pushed and slid, and an immoderate load is applied to the contact arm after the sliding movement is finished, if there is no build-up portion. In contrast, if there is the build-up portion, even when the sliding movement of the contact arm is finished, the gap between the nose portion and the contact arm is not formed. As a result, a space for deforming the contact arm is reduced to suppress the deformation of the contact arm.

The receiving portion may include a projection 22 to which the leading end portion 20*a* of the contact arm 20 abuts by the sliding of the contact arm 20 toward the base end of the nose portion 16.

According to this structure, the receiving portion includes the projection which abuts against the U-type leading end portion of the contact arm when the contact arm is pushed. The load applied to the contact arm can be absorbed by the projection, thereby preventing the deformation of the contact arm. That is, even when the sliding movement of the contact arm is finished, the contact arm comes into contact with the projection, and thus the projection directly receives the load, thereby preventing the deformation of the contact arm.

The driving tool may include a grip 12*a* extending in a direction perpendicular to the driving direction. The projection 22 may protrude further than the contact arm 20 in a direction opposite to said direction that the grip 12*a* extends.

According to this structure, the projection protrudes more than the contact arm in the direction opposite to the grip. In this way, even in the case where the driving tool is fallen from the side opposite to the grip portion, the projection first comes into contact with the concrete surface or the like earlier than the contact arm, thereby preventing the deformation of the contact arm.

What is claimed is:

1. A driving tool comprising:

a nose portion that guides a fastener in a driving direction from a base end of the nose portion to a leading end of the nose portion, the nose portion having a first side surface opposite to a second side surface that extend from the base end to the leading end of the nose portion, the leading end of the nose portion including a third side surface that forms a receiving portion and that intersects the first side surface and the second side surface; and a contact arm including a wire rod provided along the first side surface and the second side surface of the nose portion, the wire rod being bent in a leading end portion of the contact arm in a direction toward the third side surface of the nose portion such that the wire rod is bent at an angle to the driving direction of the fastener, wherein the nose portion and the contact arm are arranged such that the contact arm is slidable along the nose portion between an extended position, in which the leading end portion of the contact arm is positioned away from the base end of the nose portion in the driving direction, and a retracted position, in which the leading end portion of the contact arm is positioned toward the base end of the nose portion in a direction opposite to the driving direction, wherein, when the contact arm is in the retracted position by a sliding of the contact arm toward the base end of the nose portion, the leading end portion of the contact arm surrounds the first side surface, the second side surface, and the third side surface of the leading end of the nose portion and a surface of the receiving portion is closely facing to an inner surface of the leading end portion of the contact arm the receiving portion is adapted to prevent the contact arm from being deformed to a side of the leading end of the nose portion.

2. The driving tool according to claim 1, wherein the receiving portion includes a build-up portion formed on a position, which is corresponding to the inner surface of the leading end portion of the contact arm when the contact arm is in the retracted position, of the nose portion, and the build-up portion receives the load applied to the contact arm.

3. The driving tool according to claim 1, wherein the receiving portion includes a projection to which the leading end portion of the contact arm abuts by the sliding of the contact arm toward the base end of the nose portion.

4. The driving tool according to claim 3, further comprising a grip extending in a direction perpendicular to the driving direction, wherein the projection protrudes more than the contact arm in a direction opposite to said direction that the grip extends.

* * * * *